US007856760B2

(12) United States Patent
Klingbyle

(10) Patent No.: US 7,856,760 B2
(45) **Date of Patent: *Dec. 28, 2010**

(54) PRE-HUNG DOOR ASSEMBLY INSTALLATION KIT

(76) Inventor: Scott G. Klingbyle, 3451 Turner Road, Windsor, ON (CA) N8W 3M6

( * ) Notice: Subject to any disclaimer, the term of this patent is extended or adjusted under 35 U.S.C. 154(b) by 553 days.

This patent is subject to a terminal disclaimer.

(21) Appl. No.: 11/380,245

(22) Filed: Apr. 26, 2006

(65) Prior Publication Data

US 2006/0236623 A1 Oct. 26, 2006

Related U.S. Application Data

(63) Continuation-in-part of application No. 11/113,834, filed on Apr. 25, 2005, now Pat. No. 7,581,352.

(51) Int. Cl.
*E06B 1/04* (2006.01)

(52) U.S. Cl. ..... 49/380; 206/325

(58) Field of Classification Search ..... 49/380; 206/325; 292/253; 52/127.2
See application file for complete search history.

(56) References Cited

U.S. PATENT DOCUMENTS

| | | | | |
|---|---|---|---|---|
| 2,919,798 | A | 1/1960 | Gottlieb | |
| 3,226,781 | A * | 1/1966 | Schnabel | 52/98 |
| 3,301,820 | A | 1/1967 | Haendiges | |
| 3,411,240 | A | 11/1968 | Groat | |
| 3,473,265 | A | 10/1969 | Norman et al. | |
| 3,584,416 | A | 6/1971 | Baumgartel | |
| 3,599,373 | A | 8/1971 | Coykendall | |
| 4,718,195 | A * | 1/1988 | Ortega | 49/380 |
| 4,739,561 | A | 4/1988 | Mills | |
| 5,159,782 | A | 11/1992 | Sales | |
| 5,365,697 | A | 11/1994 | Vanderpan | |
| 5,655,332 | A | 8/1997 | Papadopoulos | |
| 5,718,082 | A * | 2/1998 | Mori | 49/380 |
| 6,170,198 | B1 | 1/2001 | Staples et al. | |
| 6,389,644 | B1 | 5/2002 | Russo | |
| 6,725,604 | B1 | 4/2004 | Vanderpan | |
| 7,121,045 | B2 * | 10/2006 | Massey et al. | 49/380 |
| 2004/0060241 | A1 * | 4/2004 | Staples et al. | 49/380 |

* cited by examiner

*Primary Examiner*—Gregory J. Strimbu
(74) *Attorney, Agent, or Firm*—Fraser Clemens Martin & Miller LLC; William J. Clemens

(57) ABSTRACT

A kit for installing a door assembly including a plurality of door frame brackets adapted to be attached to a door frame and to a wall having an opening in which the door assembly is to be installed and a lockset bracket adapted to be attached to a lockset hole formed in an edge surface of the door and to the door frame, the lockset bracket being operable to fix the door in relation to the door frame and the door frame brackets being operable to fix the door assembly relative to the opening.

12 Claims, 6 Drawing Sheets

PRE-HUNG DOOR ASSEMBLY INSTALLATION KIT

CROSS-REFERENCE TO RELATED APPLICATION

This application is a continuation-in-part of the U.S. patent application Ser. No. 11/113,834 filed Apr. 25, 2006, now U.S. Pat. No. 7,581,352.

BACKGROUND OF THE INVENTION

The present invention relates generally to pre-hung doors and, in particular, to a kit for installing a pre-hung residential door assembly that allows for improved, easier installation of a pre-hung door assembly adjacent an opening in a residential wall.

A typical pre-hung residential door assembly includes a substantially rectangular door frame having a preferably wood door hingedly attached thereto. The door assembly is configured for attachment to walls of a rough opening formed in a residential wall, for example in a house, a garage, or the like. These pre-hung door assemblies are advantageous in that the frame and the door are pre-aligned, requiring only the frame to be attached and aligned to the rough opening and eliminating the step of aligning the orienting the door to the frame.

The following U.S. patents and published patent application are relevant to pre-hung door assemblies and/or installation of pre-hung doors, the U.S. Pat. Nos. 2,919,798, 3,301,820, 3,411,240, 3,473,265, 3,584,416, 3,599,373, 4,718,195, 4,739,561, 5,159,782, 5,365,697, 5,655,332, 6,170,198, 6,725,604, and the U.S. Patent Application No. 2004/0060241.

While pre-hung door assemblies are advantageous and eliminate the step of aligning and orienting the door to the frame, properly aligning and orienting the door assembly in the rough opening remains a difficult and often time-consuming task due in part to the weight of the door assembly and in part to the need to shim the assembly in the opening. Often, after the shims have been inserted, some or all of the shims move or fall out when the door is opened to test the fit.

It is desirable, therefore, to allow for easier and quicker installation of a pre-hung door assembly that maintains the alignment between the door frame and the door while installing the pre-hung door assembly.

SUMMARY OF THE INVENTION

The present invention concerns a kit for installing a pre-hung door assembly to a rough opening in a residential wall.

A kit for installing a door assembly including a plurality of door frame brackets adapted to be attached to a door frame and to a wall having an opening in which the door assembly is to be installed, a plurality of door brackets adapted to be attached to a door and the door frame, and a lockset bracket adapted to be attached to a lockset hole formed in an edge surface of the door and to the door frame, the door brackets and the lockset bracket being operable to fix the door in relation to the door frame and said door frame brackets being operable to fix the door assembly relative to the opening.

The kit in accordance with the present invention is adapted to engage with a pre-hung residential door assembly, which includes a substantially rectangular door frame having a preferably wood door hingedly attached thereto. The door assembly is configured for attachment to walls of a rough opening formed in a residential wall, for example in a house, a garage, or the like.

The kit in accordance with the present invention includes at least one and preferably a plurality of door frame brackets, at least one and preferably a plurality of door brackets and at least one lockset bracket. Each bracket is preferably adapted to be attached to a predetermined location on the pre-hung residential door assembly.

The kit in accordance with the present invention allows for improved, easier, and quicker installation of a door assembly and advantageously keeps the door frame and the door aligned during installation of the door assembly.

DESCRIPTION OF THE DRAWINGS

The above, as well as other advantages of the present invention will become readily apparent to those skilled in the art from the following detailed description of a preferred embodiment when considered in the light of the accompanying drawings in which.

DESCRIPTION OF THE PREFERRED EMBODIMENT

Figure 1:
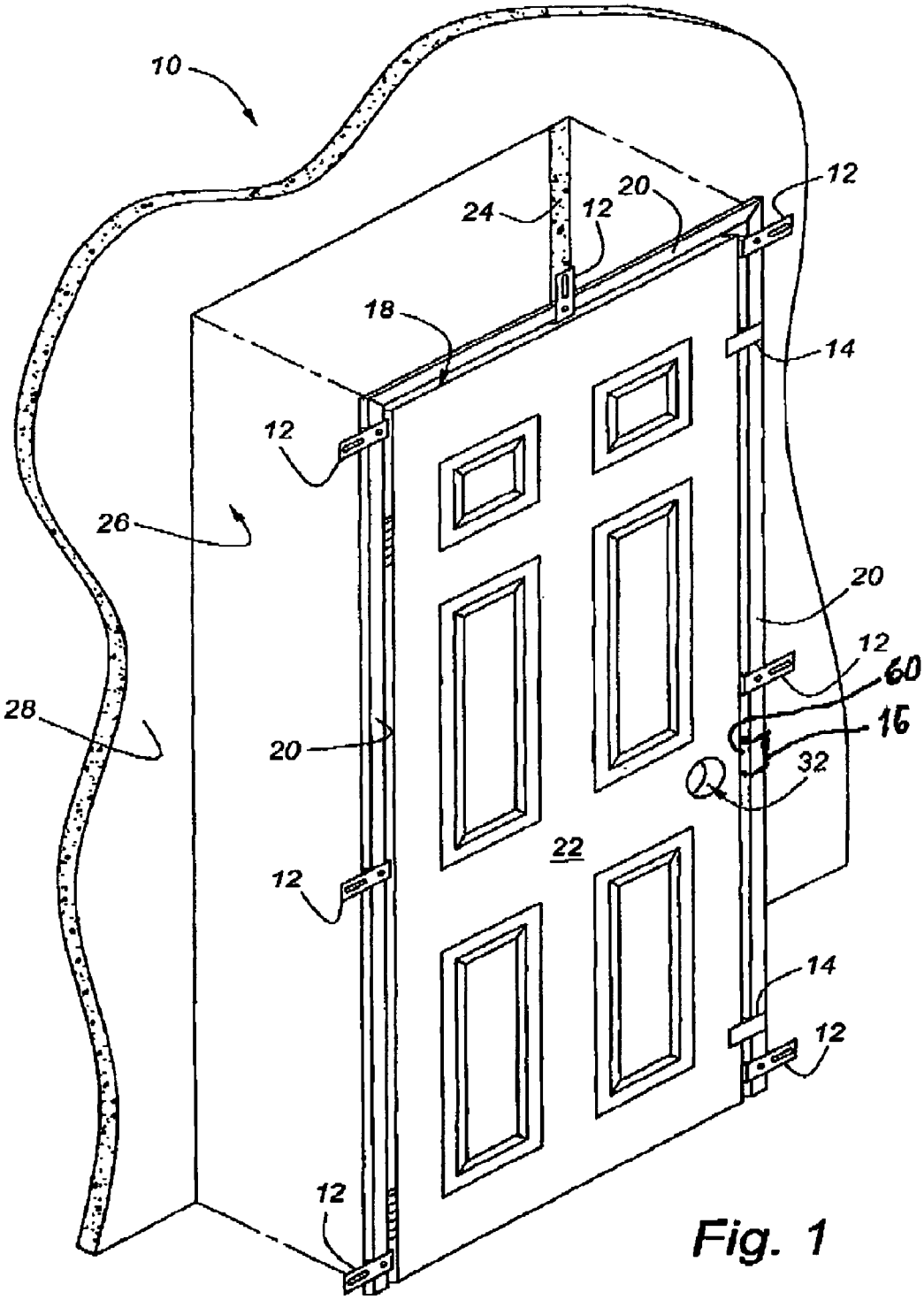
FIG. 1 is a front elevation view of a kit in accordance with the present invention shown attached to a pre-hung door assembly.

Referring now to FIG. 1, a pre-hung door installation kit in accordance with the present invention is indicated generally at 10. The kit 10 includes at least one and preferably a plurality of generally F-shaped door frame brackets 12, at least one and preferably a plurality of door brackets 14, and at least one lockset bracket 16.

Figure 2:
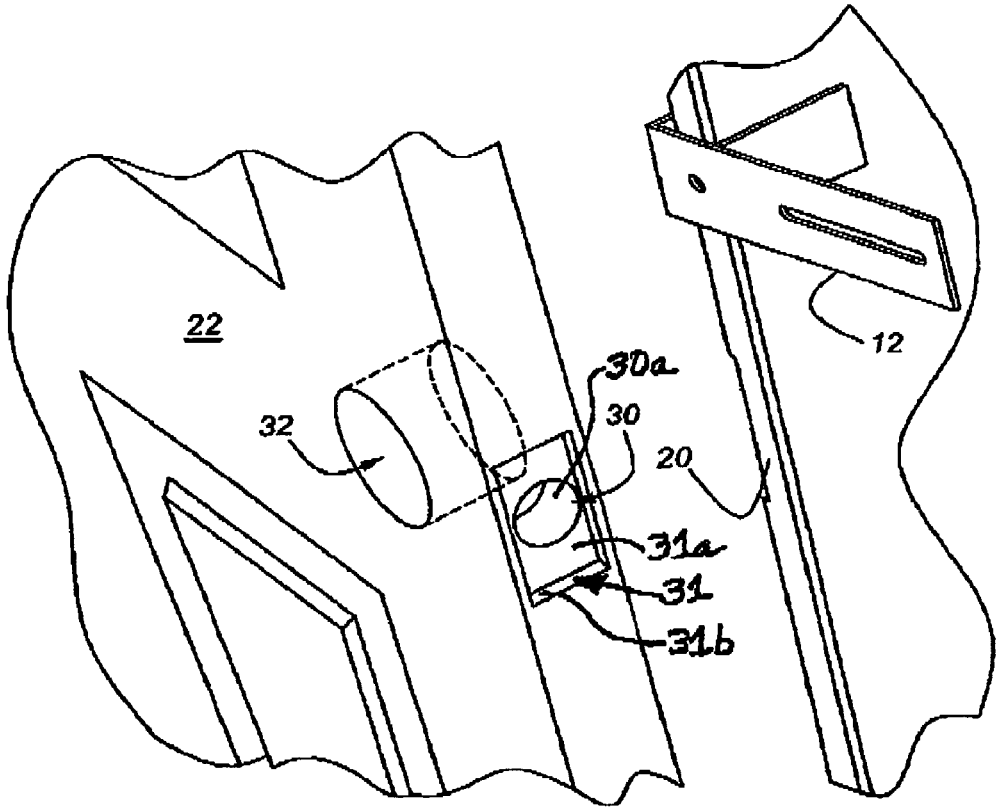
FIG. 2 is a fragmentary perspective view of the lock area of the door shown in FIG. 1.

The brackets 12, 14, and 16 of the kit 10 are adapted to be attached at various locations on a pre-hung door assembly 18, best seen in FIG. 1 and discussed in more detail below. The door assembly 18 includes a substantially rectangular door frame 20 having a preferably wood door 22 hingedly attached thereto. The door assembly 18 is configured for attachment to surfaces 24 of a rough opening 26 formed in a residential building wall 28, for example in a house, a garage, or the like. The wall 28 may be an interior wall or an exterior wall and the door assembly 18 may be configured as an interior door (with a typically wood door 22) or an exterior door (with a typically steel door), as will be appreciated by those skilled in the art. The door 22 includes a lockset hole 30, best seen in FIG. 2, formed in a side edge surface thereof. Surrounding the lockset hole 30 is a generally rectangular latch plate recess 31 having a bottom surface 31*a* positioned inwardly (recessed) from the side edge surface of the door 12. The lockset hole 30 also includes a cylindrical portion 30*a* that extends from the bottom surface 31*a* to a door knob hole 32 formed through front and rear surfaces of the door 22.

Figure 3:
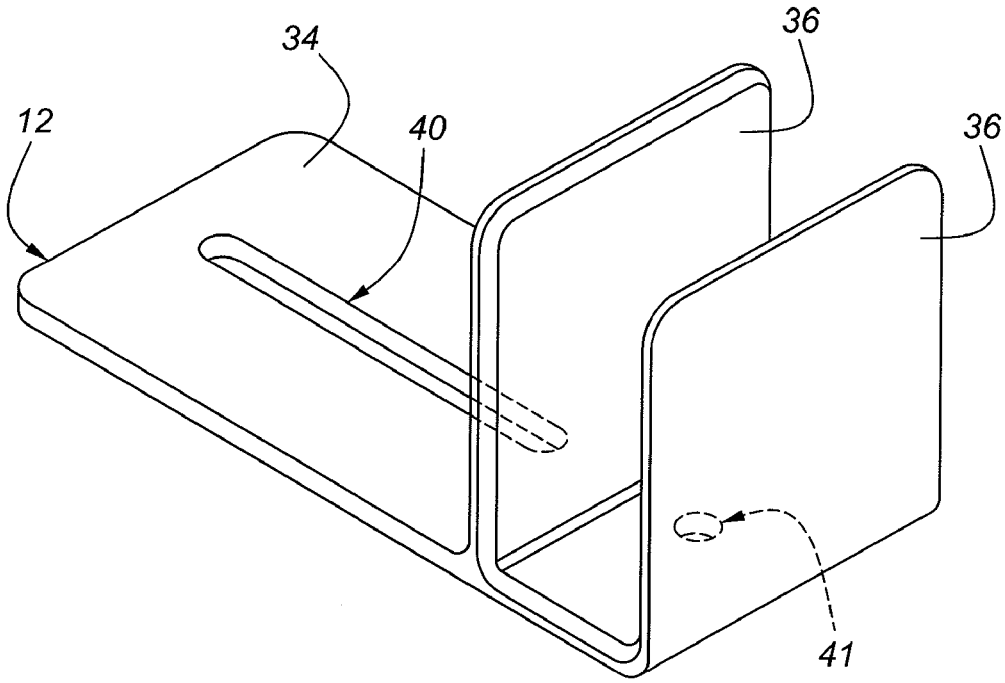
FIG. 3 is a perspective view of a door frame bracket of the kit in accordance with the present invention.
Figure 4:
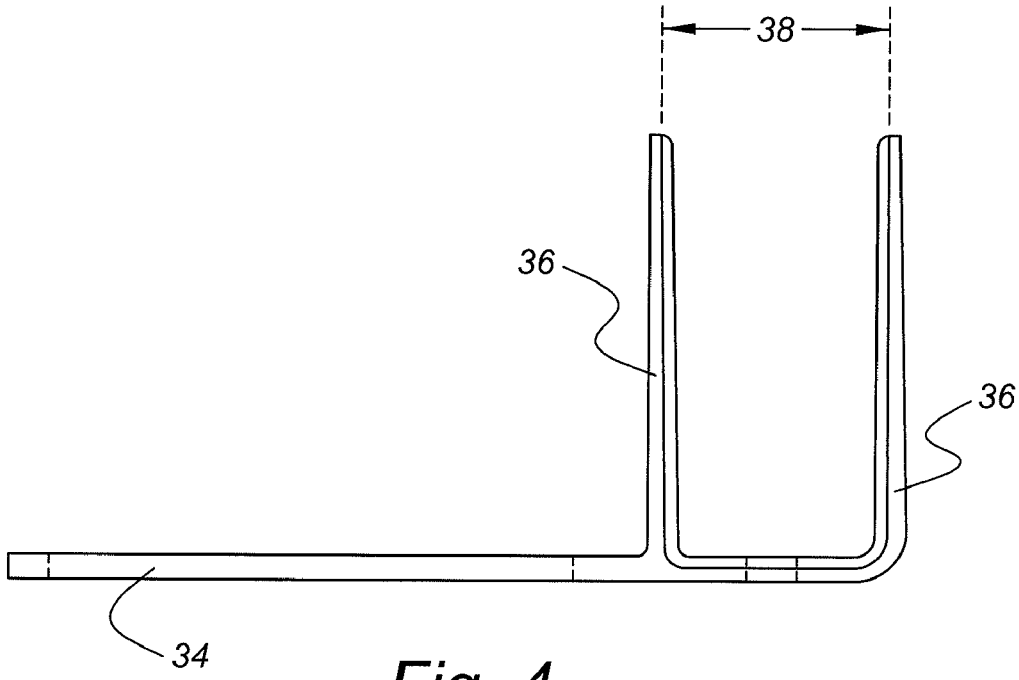
FIG. 4 is a top plan view of the door frame bracket of FIG. 3.

Referring now to FIGS. 3-4, the kit 10 includes at least one and preferably a plurality of the generally F-shaped door frame brackets 12. The door frame brackets 12 include a base 34 and a pair of arms 36 extending from the base 34 that are spaced apart by a predetermined distance, indicated by an arrow 38. The predetermined distance 38 is preferably sized to provide a snug fit for the door frame bracket 12 against the frame 20 of the door assembly 18, discussed in more detail below. The base 34 defines an elongated hole or slot 40 extending through upper and lower surfaces thereof. The hole 40 is sized to accept a fastener (not shown) or the like when the kit 10 is used to attach the door assembly 18 to the surfaces 24 of the rough opening 26. The base 34 may also define an aperture 41 in a portion of the base 34 between the arms 36 for receiving a fastener or the like.

Figure 5:
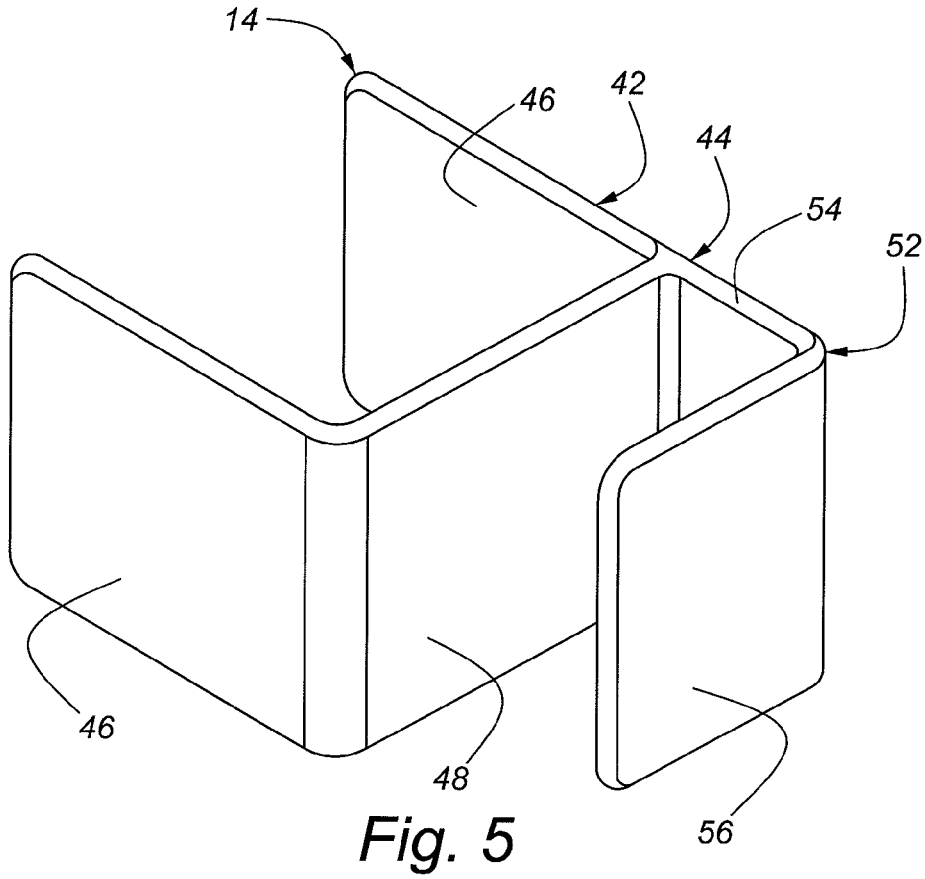
FIG. 5 is a perspective view of a door bracket of the kit in accordance with the present invention.
Figure 6:
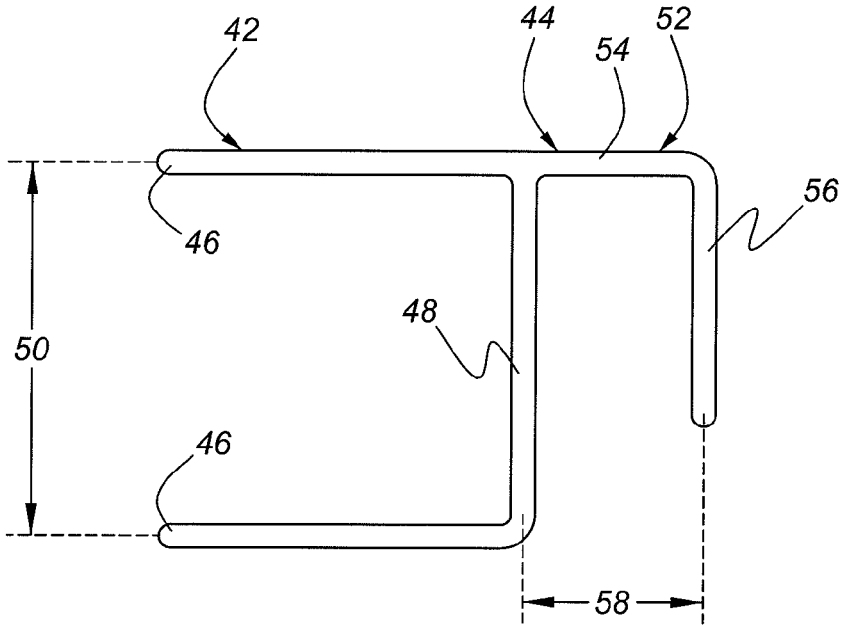
FIG. 6 is a top plan view of the door bracket of FIG. 5.

Referring now to FIGS. 5-6, the kit 10 includes at least one and preferably a plurality of the door brackets 14, which include a first generally C-shaped door-engaging portion 42 that is adapted to engage with the door 22 and a second generally L-shaped frame-engaging portion 44 extending from the first portion 42 that is adapted to engage with the door frame 20. The first portion 42 includes a pair of arms 46 extending from a base 48 that are spaced apart by a predetermined distance, indicated by an arrow 50. The predetermined distance 50 is preferably sized to provide a snug fit for the door bracket 14 against the peripheral surface of the door 22 of the door assembly 18, discussed in more detail below. The second portion 44 includes an arm 52 having a first section 54 extending from the base 48 in a direction opposite the arms 46 and second bent over section 56 that defines a space, indicated by an arrow 58, between the bent over section 56 and the base 48. The predetermined distance 58 is preferably sized to provide a snug fit for the door bracket 14 against the frame 20 of the door assembly 18, discussed in more detail below.

Figure 7:
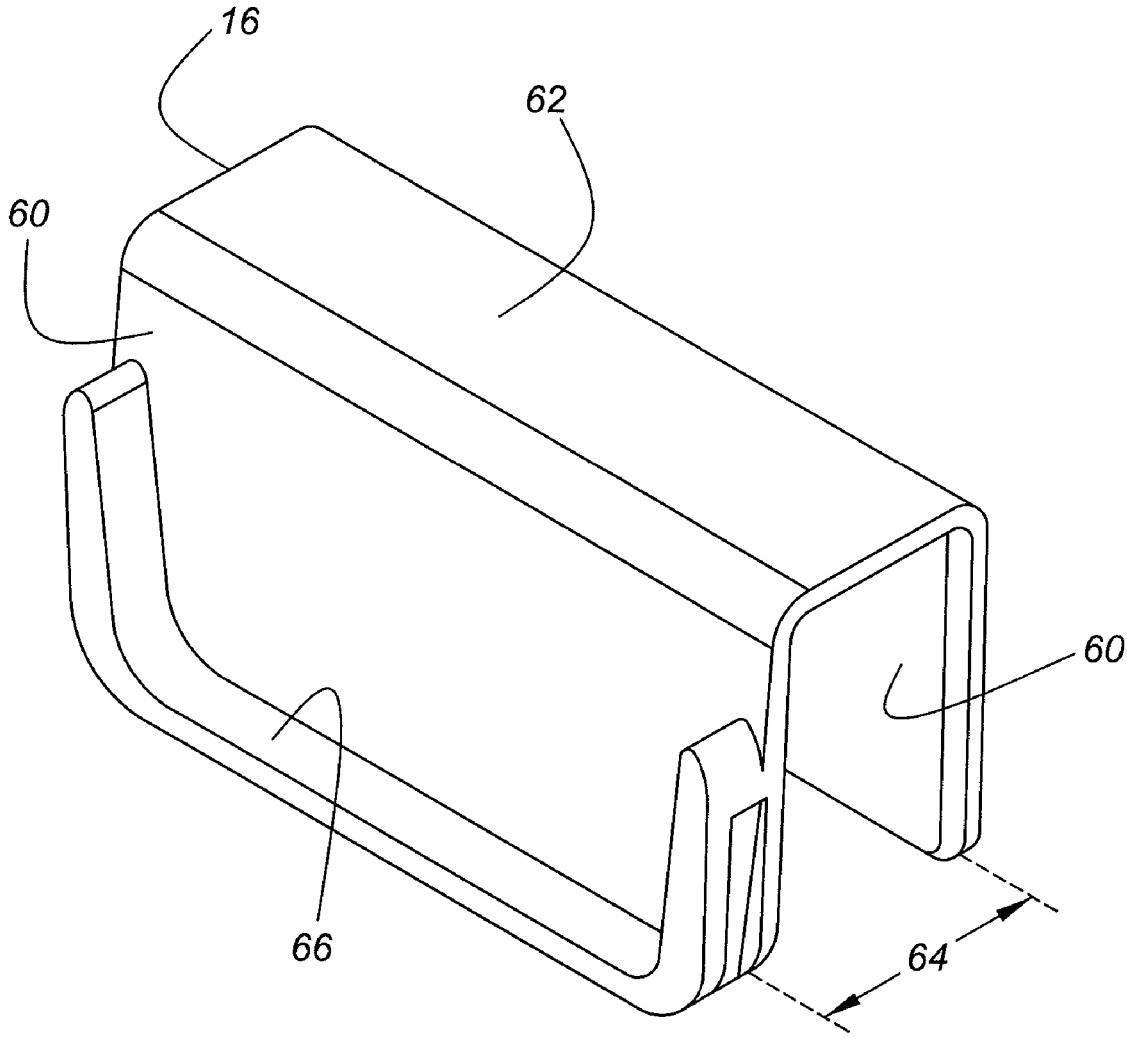
FIG. 7 is a perspective view of a lockset bracket of the kit in accordance with the present invention.

Referring now to FIG. 7, the kit 10 includes at least one lockset bracket 16 which includes a generally C-shaped body having a pair of arms 60 extending from a base 62 that are spaced apart by a predetermined distance, indicated by an arrow 64. The predetermined distance 64 is preferably sized to provide a snug fit for the lockset bracket 16 against the frame 20 of the door assembly 18, discussed in more detail below. A projection 66 extends outwardly from an outer surface of one of the arms 60. The projection 66 is adapted to engage with the walls 31*b* that define the lockset hole 30 latch plate recess 31 formed in the peripheral surface of the door 22. While illustrated as substantially C-shaped, the projection 66 may conform to the outer surface of the arm 60 and is preferably sized to engage with the walls of the lockset hole 30 so as to prevent the door 22 from moving with respect to the door frame 20 during use of the kit 10, discussed in more detail below.

The door frame brackets 12, the door brackets 14, and the at least one lockset bracket 16 are preferably formed from a plastic material by, for example, an injection molding process. A suitable plastic material for one-time use of the kit is ABS (acrylonitrile-butadiene-styrene). A suitable material for a reusable kit is glass filled nylon. Similar plastic materials also can be used. By forming the door frame brackets 12, the door brackets 14, and the at least one lockset bracket 16 from a plastic material, the kit 10 may be made advantageously light weight and easy to manipulate during the installation of the pre-hung door assembly 18, discussed in more detail below. Alternatively, the door frame brackets 12, the door brackets 14, and the at least one lockset bracket 16 are formed from any material having suitable material strength characteristics for use in a pre-hung door installation kit 10.

The predetermined distances 38, 50, and 64 may be any distance as determined by the type of door assembly 18 (such as an internal or external residential door assembly), as will be appreciated by those skilled in the art.

When ready to install the door assembly 18, the door frame brackets 12 are engaged with the door frame 20 by placing the arms 36 of the bracket 12 on opposing sides of the frame 20 and placing the base 34 between the arms 36 into close proximity with the outer surface of the frame 20. Preferably, the door frame brackets 12 are attached to the frame 20 of the door assembly 18 prior to placing the door assembly 18 adjacent the rough opening 26. The door frame brackets 12 may be secured to the frame 20 by placing a fastener, such as a wood screw or the like, through the aperture 41 to ensure that the door frame brackets 12 remain in a fixed location with respect to the frame 20 during use of the kit 10.

The door brackets 14 are engaged with the door 22 by placing the arms 46 of the first portion 42 of the bracket 12 on opposing sides of the door 22 and placing the base 48 between the arms 46 into close proximity to the peripheral surface of the door 22. This is preferably done while the door 22 is in a position swung away from the door frame 20. The door brackets 14 are then engaged with the door frame 22 by swinging the door 22 to a closed position and placing the second section 56 of the arm 52 and the base 48 on opposing sides of the frame 20 and placing the first section 54 of the arm 52 into close proximity with the outer surface of the frame 20.

The lockset bracket 16 is engaged with the door 22 by placing the projection 66 of the bracket 16 into engagement with the surfaces defined by the lockset hole 30 on the peripheral surface of the door 22. This is preferably done while the door 22 is in a position swung away from the door frame 20. Preferably, the projection 66 engages with the surfaces in an interference or press-type fit. The lockset bracket 16 is then engaged with the door frame 20 by swinging the door 22 to the closed position and placing the arms 60 on opposing sides of the frame 20 and placing the base 62 into close proximity with the outer surface of the frame 20. Preferably the door brackets 14 and the lockset bracket 16 are engaged with the door 22 and the recess 31 of the lockset hole 30, respectively, in succession prior to swinging the door 22 to the closed position.

After the brackets 12, 14, and 16 are engaged with frame 20 and the door 22 of the assembly 18, the assembly 18 is then placed adjacent the rough opening 26. The door frame brackets 12 are then attached to the walls 28 adjacent the rough opening 26, such as by placing a fastener such as a nail, a drywall screw, or the like (not shown) through the elongated holes 40 of the brackets 12 and extends into the walls 28. Preferably, the fasteners are placed to allow for movement of the assembly 18 within the rough opening 26. As seen in FIG. 1, the brackets 12 are placed on the opposing sides (the left and right sides as seen in FIG. 1) of the frame 20, which allows for horizontal adjustment of the assembly 18 with respect to the opening 26 and on the upper or top side of the frame 20, which allows for vertical adjustment of the assembly 18 with respect to the rough opening 26. When the fasteners are placed in the brackets 12 and extend into the walls 28, the brackets 12 and fasteners support the weight of the assembly 18, advantageously allowing the user of the kit 10 to more easily manipulate the assembly 18 into a desired orientation within the rough opening 26.

While the user of the kit 10 aligns the assembly 18 with respect to the surfaces 24 and the walls 28 of the rough opening 26, the door brackets 14 and the lockset bracket 16 maintain the relationship between the door 22 and the frame 20 while the user makes adjustments to the assembly 18, such as leveling, aligning, and orienting the door assembly 18 with respect to the surfaces 24 and the wall 28 of the rough opening 26 including the use of shims and the like (not shown). Because the lockset hole 30 is formed in the door 22 at a predetermined location with respect to the frame 20 when the door 22 and the door frame 20 are manufactured to form the assembly 18, the lockset bracket 16 of the kit 10 advantageously makes use of this relationship and maintains correct alignment between the door frame 20 and the door 22 during use of the kit 10.

After the assembly 18 is aligned in a desired position, the frame 20 is fixedly attached to the surfaces 24 of the rough opening 26 such as by nailing or the like. After the assembly 18 is attached to the surfaces 24, the kit 10 is removed, and the assembly 18 is typically framed with molding (not shown) or the like that attaches to the walls 28 and covers the exterior surface of the frame 20 of the door assembly 18 to provide a pleasing appearance as is known in the art.

In an embodiment of the kit 10, there are seven of the door frame brackets 12, two of the door brackets 14 and one lockset bracket 16. Preferably during use of the kit 10, three of the door frame brackets 12 are located on each of the sides of the frame 20 and one of the brackets is located on the top of the frame 20. Preferably during use of the kit 10, the door brackets 14 are located above and below the door knob hole 32 and the lockset bracket 16 is located in the latch plate recess 31 of the lockset hole 30.

The kit 10 in accordance with the present invention allows for improved, easier, and quicker installation of a pre-hung door assembly 18 and advantageously keeps the door frame 20 and the door 22 aligned during installation of the door assembly 18. In addition, the kit 10 is advantageously reusable such that a plurality of pre-hung door assemblies 18 may be installed utilizing the same kit 10, making the kit 10 particularly advantageous for finish carpenters and the like during new home construction or remodeling projects.

Figure 8:
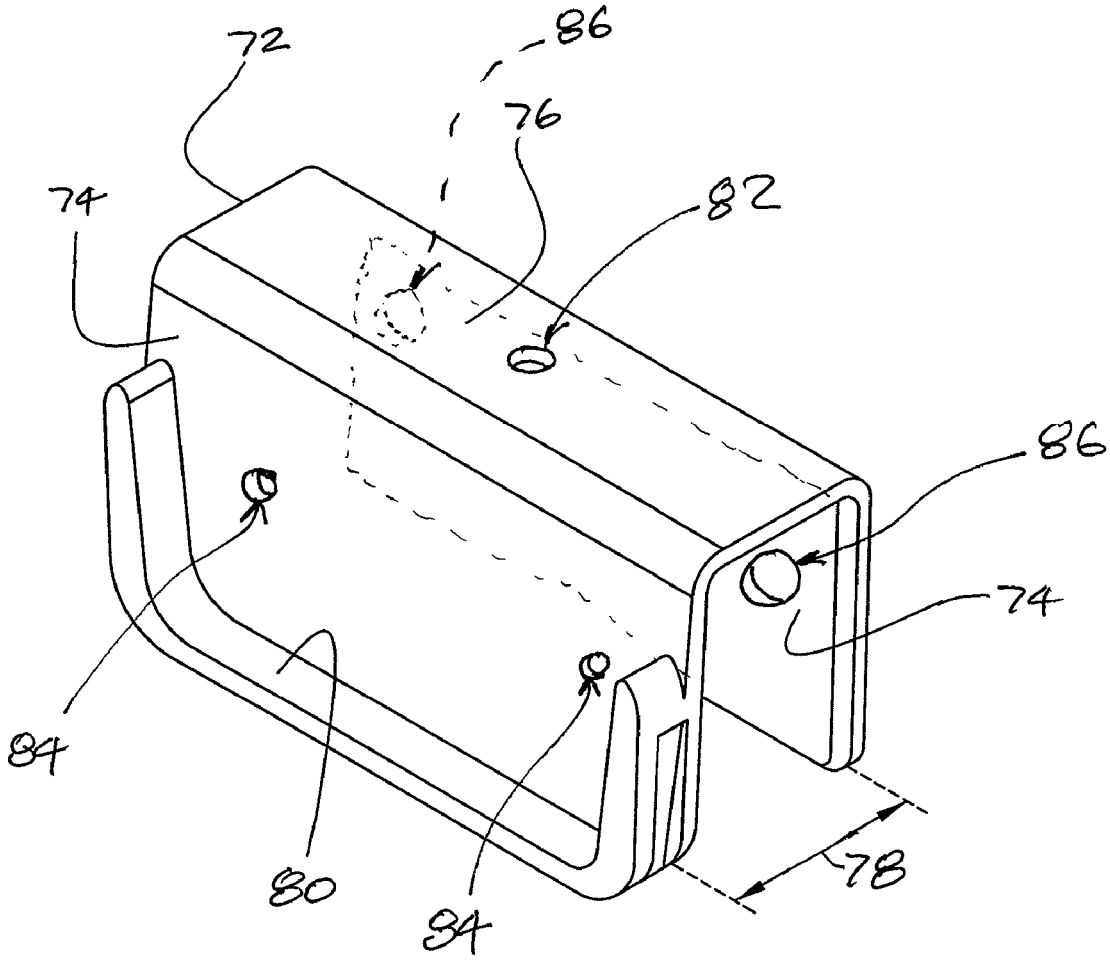
FIG. 8 is a perspective view of an alternative embodiment of a lockset bracket in accordance with the present invention.

Referring now to FIG. 8, an alternative embodiment of a kit (not numbered) includes at least one lockset bracket 72 which includes a generally C-shaped body having a pair of arms 74 extending from a base 76 that are spaced apart by a predetermined distance, indicated by an arrow 78. The predetermined distance 78 is preferably sized to provide a snug fit for the lockset bracket 72 against the frame 20 of the door assembly 18, discussed in more detail below. A projection 80 extends outwardly from an outer surface of one of the arms 74. The projection 80 is adapted to engage with the walls that define the lockset hole 30 formed in the peripheral surface of the door 22. While illustrated as substantially C-shaped, the projection 80 may conform to the outer surface of the arm 74 and is preferably sized to engage with the walls of the lockset hole 30 so as to prevent the door 22 from moving with respect to the door frame 20 during use of the alternative kit, discussed in more detail below. The alternative lockset bracket 72 includes at least one aperture 82 extending through the base 76 thereof. The bracket 72 also includes at least one aperture 84 extending through one of the arms 60 and at least one aperture 86 extending through the other of the arms 60. The apertures 84 are preferably of a smaller diameter than the apertures 86 and the apertures 84 and 86 are preferably coaxial such that an elongated tool, such as a screwdriver or the like, may pass through both the apertures 84 and 86.

The apertures 84 and 86 allow a fastener (not shown) such as a screw, a nail, or the like to fixedly attach the lockset bracket 72 directly to the walls of the lockset hole 30. The aperture 86 allows a tool and fastener, such as a screwdriver and a screw or the like, to pass therethrough and to insert the fastener through the apertures 84 to attach the lockset bracket 72 to the walls of the lockset hole 30. Similarly, the aperture 82 allows a fastener (not shown), such as a screw, a nail, or the like, to attach the lockset bracket 72 directly to the door frame 20.

Similar to the door frame brackets 12, the door brackets 14, and the at least one lockset bracket 16, the lockset bracket 72 is preferably formed from a plastic material by, for example, an injection molding process. A suitable plastic material for one-time use of the kit is ABS (acrylonitrile-butadiene-styrene). A suitable material for a reusable kit is glass filled nylon. Similar plastic materials also can be used.

The alternative kit in accordance with the present invention does not include the at least one door bracket 14 shown in FIGS. 5 and 6 but rather includes a plurality of door frame brackets 12 and the alternative embodiment of the lockset bracket 72 shown in FIG. 8. When ready to install the door assembly 18, the door frame brackets 12 are engaged with the door frame 20 by placing the arms 36 of the bracket 12 on opposing sides of the frame 20 and placing the base 34 between the arms 36 into close proximity with the outer surface of the frame 20. Preferably, the door frame brackets 12 are attached to the frame 20 of the door assembly 18 prior to placing the door assembly 18 adjacent the rough opening 26. The door frame brackets 12 may be secured to the frame 20 by placing a fastener, such as a wood screw or the like, through the aperture 41 to ensure that the door frame brackets 12 remain in a fixed location with respect to the frame 20 during use of the alternative kit.

The lockset bracket 72 is engaged with the door 22 by placing the projection 80 of the bracket 72 into engagement with the surfaces defined by the lockset hole 30 on the peripheral surface of the door 22. This is preferably done while the door 22 is in a position swung away from the door frame 20. Preferably, the projection 80 engages with the surfaces in an interference or press-type fit. A fastener (not shown) is passed through the apertures 84 and 86 to removably attach the lockset bracket 72 to the walls of the lockset hole 30. The lockset bracket 72 is then engaged with the door frame 20 by swinging the door 22 to the closed position and placing the arms 74 on opposing sides of the frame 20 and placing the base 76 into close proximity with the outer surface of the frame 20. A fastener (not shown) is then passed through the aperture 82 to removably attach the lockset bracket 72 to the frame 20.

After the brackets 12 and 76 of the alternative kit are attached to the pre-hung door assembly 18, the user of the alternative kit aligns the assembly 18 with respect to the surfaces 24 and the walls 28 of the rough opening 26 and fixedly attaches to the surfaces 24 of the rough opening 26 such as by nailing or the like in a manner similar to the kit 10 outlined above. After the assembly 18 is attached to the surfaces 24, the alternative kit is removed, and the assembly 18 is typically framed with molding (not shown) or the like that attaches to the walls 28 and covers the exterior surface of the frame 20 of the door assembly 18 to provide a pleasing appearance as is known in the art.

The combination of utilizing at least one fastener to fixedly attach the lockset bracket 72 to the walls of the lockset hole 30 and at least one fastener to fixedly attach the lockset bracket 72 to the door frame 20 advantageously provides a potentially more robust connection to prevent the door 22 from moving with respect to the door frame 20 than the combination of the interference or press-type fit of the projection 80 engaging with the walls of the lockset hole 30 and placing the base 76 into close proximity with the outer surface of the frame 20.

Similar to the kit 10, the alternative kit in accordance with the present invention allows for improved, easier, and quicker installation of a pre-hung door assembly 18 and advantageously keeps the door frame 20 and the door 22 aligned during installation of the door assembly 18, while advantageously utilizing fewer parts than the kit 10. In addition, the alternative kit is advantageously reusable such that a plurality of pre-hung door assemblies 18 may be installed utilizing the same kit, making the alternative kit particularly advantageous for finish carpenters and the like during new home construction or remodeling projects.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A pre-hung door assembly installation kit for attaching a pre-hung door assembly to surfaces adjacent a rough opening in a wall, the pre-hung door assembly including a door frame and a door hingedly attached to the door frame, the installation kit comprising:

at least one door frame bracket adapted to engage with the door frame and to releasably attach to one of the surfaces adjacent the opening; and a lockset bracket having a single one-piece, unitary construction and a generally C-shaped body, said lockset bracket adapted to engage with a latch plate recess formed in a peripheral surface of the door and adapted to engage with the door frame, said lockset bracket body having an arm, said arm having a first aperture formed therein for receiving a fastener, said lockset bracket, when engaged and fastened to the door by the fastener in said first aperture, being operable to fix the door in relation to the door frame with said arm extending between the peripheral surface of the door and the door frame, said at least one door frame bracket, when engaged with the door frame and engaged and releasably attached to the one surface adjacent the opening, being operable to allow a user of the kit to align and orient the pre-hung door assembly with the surfaces adjacent the opening in the wall, wherein said at least one door frame bracket is removable from the door frame and the one surface and said lockset bracket is removable from the door frame and the door after the door assembly is installed in the wall and said at least one door frame bracket and said lockset bracket are reusable while the door assembly remains in use in the opening, wherein said lockset bracket includes a projection extending from said arm for engagement with the latch plate recess, the projection being generally C-shaped and sized to engage with walls of the latch plate recess so as to prevent the door from moving with respect to the door frame during use of the kit wherein the generally C-shaped body opens in a first direction and the generally C-shaped projection opens in a second direction opposite to the first direction.

2. The kit according to claim 1 wherein said at least one door frame bracket is a plurality of door frame brackets.

3. The kit according to claim 1 wherein said at least one door frame bracket is a generally F-shaped bracket

4. The kit according to claim 1 wherein said at least one door frame bracket defines an aperture therein for receiving a fastener to secure said at least one door frame bracket to the door frame.

5. The kit according to claim 1 wherein said at least one door frame bracket is formed from a plastic material.

6. The kit according to claim 1 wherein said generally C-shaped projection of said lockset bracket is adapted to be press-fit in the latch plate recess.

7. The kit according to claim 1 wherein said lockset bracket has another aperture formed therein for receiving another fastener.

8. The kit according to claim 1 wherein said lockset bracket has a second aperture formed therein wherein said second aperture is larger than said first aperture and is coaxial with said first aperture for receiving a tool.

9. The kit according to claim 1 wherein said lockset bracket has another aperture formed therein for receiving a fastener to fixedly attach said lockset bracket to the door frame.

10. The kit according to claim 1 wherein said lockset bracket is formed from a plastic material.

11. A door assembly installation kit for attaching a pre-hung door assembly to surfaces adjacent a rough opening in a wall, the pre-hung door assembly including a door frame and a door hingedly attached to the door frame, the installation kit comprising:

a plurality of door frame brackets adapted to be attached to the door frame and to the surfaces adjacent the rough opening in the wall;

a lockset bracket having a single one-piece, unitary construction and a generally C-shaped body, said lockset bracket adapted to be engaged in a latch plate recess formed in an edge surface of the door and to be removably attached to the door frame, said lockset bracket body having an arm with an aperture formed therein for receiving a fastener to attach to a bottom surface of the latch plate recess, said lockset bracket, when engaged and attached with said door frame and said door with said arm extending between the edge surface of the door and the door frame, being operable to fix the door in relation to the door frame and said door frame brackets being operable to fix the door assembly relative to the opening, wherein said lockset bracket includes a projection extending from said arm for engagement with the latch plate recess, the projection being generally C-shaped and sized to engage with walls of the latch plate recess so as to prevent the door from moving with respect to the door frame during use of the kit wherein the generally C-shaped body opens in a first direction and the generally C-shaped projection opens in a second direction opposite to the first direction.

12. A door assembly installation kit for attaching a pre-hung door assembly to surfaces adjacent a rough opening in a wall, the pre-hung door assembly including a door frame and a door hingedly attached to the door frame, the installation kit comprising:

a plurality of door frame brackets adapted to be attached to the door frame and to the surfaces adjacent the rough opening in the wall;

a lockset bracket having a single one-piece, unitary construction and a generally C-shaped body, said lockset bracket adapted to be engaged in a latch plate recess formed in an edge surface of the door and to be removably attached to the door frame, said generally C-shaped body having a pair of arms extending from a base, one of said arms having a first aperture formed therein for receiving a fastener to attach to a bottom surface of the latch plate recess, another of said arms having a second aperture formed therein wherein said second aperture is larger than said first aperture and is coaxial with said first aperture and is sized for receiving a tool for attaching said fastener to the bottom surface of the latch plate recess, said base having a third aperture formed therein for receiving another fastener to fixedly attach said lockset bracket to the door frame, said lockset bracket, when engaged and attached to the door and the door frame with said one arm extending between the edge surface of the door and the door frame, being operable to fix the door in relation to the door frame, said door frame brackets being operable to fix the door assembly relative to the opening, wherein said lockset bracket includes a projection extending form said one arm for engagement with the latch plate recess, the projection being substantially C-shaped and sized to engage with walls of the latch plate recess so as to prevent the door from moving with respect to the door frame during use of the kit wherein the generally C-shaped body opens in a first direction and the substantially C-shaped projection opens in a second direction opposite to the first direction.

* * * * *